US005531578A

United States Patent [19]

Takemoto et al.

[11] Patent Number: 5,531,578

[45] Date of Patent: Jul. 2, 1996

[54] SCROLL COMPRESSOR

[75] Inventors: Tsuyoshi Takemoto, Nukata-gun; Shigeru Hisanaga, Kariya; Yasushi Watanabe, Kariya; Tetsuhiko Fukanuma, Kariya, all of Japan

[73] Assignees: Nippondenso Co., Ltd.; Kabushiki Kaisha Toyoda Jidoshokki Seisakusho, both of Kariya, Japan

[21] Appl. No.: 403,522

[22] Filed: Mar. 13, 1995

[30] Foreign Application Priority Data

Mar. 14, 1994 [JP] Japan ..... 6-042842

[51] Int. Cl.[6] ..... F01L 1/04

[52] U.S. Cl. ..... 418/55.1; 418/98; 418/104; 277/178; 277/188 R

[58] Field of Search ..... 418/55.1, 55.6, 418/97, 98, 104; 277/178, 188 R, 189; 384/477, 484

[56] References Cited

U.S. PATENT DOCUMENTS 4,340,339 7/1982 Hiraga et al. .
4,484,869 11/1984 Nakayama et al. .
4,527,963 7/1985 Terauchi .
4,538,975 9/1985 Tsukagoshi .
4,547,138 10/1985 Mabe et al. .
4,561,832 12/1985 Shimizu ..... 418/97
5,269,661 12/1993 Iizuka et al. ..... 418/55.1
5,419,690 5/1995 Goto et al. ..... 418/55.1

*Primary Examiner*—Charles Freay
*Attorney, Agent, or Firm*—Cushman, Darby & Cushman

[57] ABSTRACT

A large diameter portion of a rotating shaft is supported by an opening in a front housing via a radial bearing. An outer race of the bearing is in contact with an inner, rear surface of the housing as a shoulder portion of the opening. The inner surface is forwardly recessed, so that a small chamber is formed between the housing and the bearing unit. The housing has a stopper projection at a rear end of an opening to which a shaft seal unit is inserted. The projection is axially projected to a faced front surface of the large diameter portion of the shaft, while a seal chamber is formed between the shaft seal unit and the large diameter portion. The seal chamber is in communication with the small chamber. A plurality of circumferentially spaced grooves for holding lubricant are formed at the recessed surface for forming the small chamber.

13 Claims, 13 Drawing Sheets

SCROLL COMPRESSOR

BACKGROUND OF THE INVENTION

1. Field of the Invention

The present invention relates to a scroll compressor which can, for example, be used for an air conditioning system. More particularly, the present invention relates, in such a scroll compressor, to a mechanism for supporting a rotating shaft to a front housing as well as to a construction for lubricating the mechanism.

2. Description of Related Art

In a conventional type of a scroll compressor, stationary and movable scroll members are arranged in a housing. The movable scroll member is arranged eccentric with respect to the stationary scroll member, so that a plurality of radially spaced pump chambers are formed between the stationary and movable scroll members. A rotating shaft is provided for transmitting a rotational movement from a rotating movement source to the movable scroll member. Namely, the shaft is formed with a large diameter portion, which is rotatably supported, via a radial bearing unit, by the housing at its front part. A rotating movement of the shaft causes the movable scroll member to effect an orbital movement about an axis of the shaft, while the movable scroll member is prevented from being rotated about its own axis, so that the pump chambers are displaced radially inwardly, while their volume is reduced. As a result, a gas introduced into the pump chambers is subjected to compression, and is discharged to a delivery chamber. The lubrication of the parts, including the scroll members, is done by a lubricant included in the gas to be compressed. A shaft seal unit for preventing the lubricant from leaking is arranged adjacent to the bearing for supporting the shaft, so that a seal chamber is formed between the shaft seal unit and the bearing. The chamber is for supplying the lubricant to the seal to obtain a desired sealing function. Furthermore, a flow of the gas to the chamber is obtained via gaps in the bearing, so that a lubrication of the bearing is done.

The provision of a large seal chamber in the front housing is defective in that the axial length of the front housing as well as the length of rotating shaft are increased, thereby increasing the total axial length as well as the weight of the compressor.

SUMMARY OF THE INVENTION

An object of the present invention is to provide a scroll compressor capable of overcoming the above difficulties in the prior art.

Another object of the present invention is to provide a shorter scroll compressor in order to reduce the size as well as the weight of the compressor, while obtaining a desired lubricating performance of the bearing unit and the seal unit for the rotating shaft.

According to the present invention, a scroll compressor for a gas including lubricant is provided, comprising:

a housing;

a drive shaft having an axis for a rotation, the drive shaft having a first portion of a small diameter and a second portion of a large diameter;

a radial bearing for supporting the drive shaft rotatably with respect to the housing;

a seal unit cooperating with the small diameter portion of the shaft for preventing the lubricant from being leaked;

a stationary scroll member which is in a fixed relationship with respect to the housing;

a movable scroll member arranged eccentric with respect to the stationary scroll member so that a plurality of pump chambers are created between the scroll members;

the housing forming, at its front portion, a first axially extending opening and a second axially extending opening of a diameter smaller than that of the first opening;

the housing being further formed with a shoulder portion between the first and second axial openings, and an inwardly extending projection at the end of the second opening adjacent to the bearing unit;

the radial bearing including an inner race fitted to the large diameter portion of the shaft, and outer race fitted to the first opening of the housing so that the outer race axially contacts said shoulder portion, and a plurality of circumferentially spaced bearing members;

the seal unit being arranged adjacent to the bearing unit on the side opposite to the scroll members, the seal unit being axially engaged with the projection;

means for connecting the movable scroll member with respect to the drive shaft so as to obtain an orbital movement of the movable scroll about the axis of the shaft;

means for preventing the movable scroll member from being rotated about its own axis, so that the orbital movement of the movable scroll member allows the chambers to be moved radially from an outward position to an inward position;

an intake means for introducting the gas to be compressed into a chamber when it is located at the radially outward position;

an outlet means for discharging the gas as compressed when the chamber is located on the radially inward position;

said housing forming, at a location inward from the shoulder portion, a recessed surface which is spaced from a faced end of the inner race of the bearing unit, so that a small space is formed between the housing and the bearing unit;

said stopper projection at the inner end of the second opening being arranged adjacent a faced end surface of said increased diameter portion of the rotating shaft so as to form a sealing chamber therebetween, and;

lubricating means, on at least one of the front housing, the radial bearing and the rotating shaft, for lubricating the radial bearing as well as the shaft seal unit.

BRIEF EXPLANATION OF ATTACHED DRAWINGS

DESCRIPTION OF PREFERRED EMBODIMENTS

Figure 1:
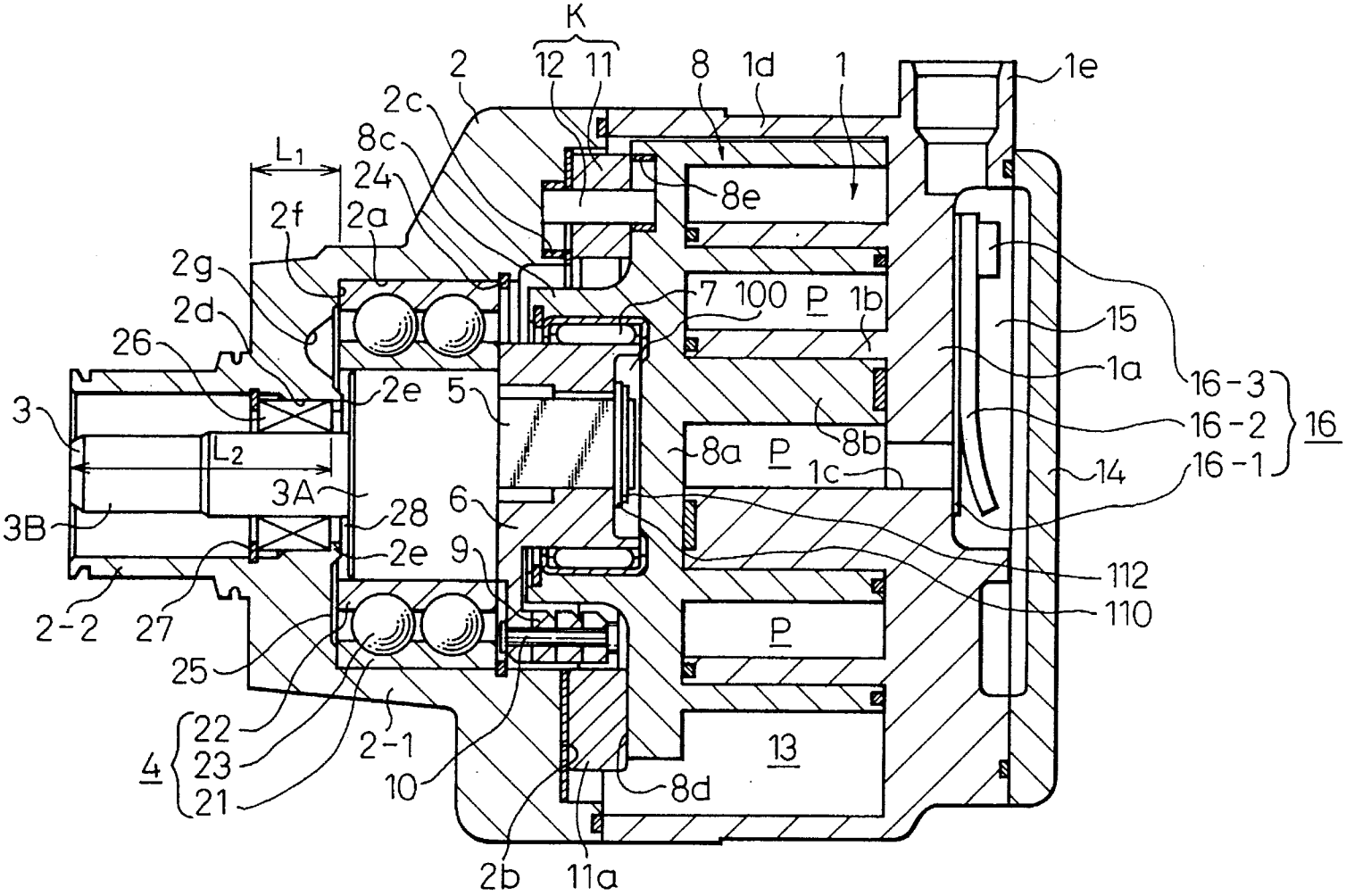
FIG. 1 is a longitudinal cross-sectional view of a scroll compressor according to the present invention.

Embodiments of the present invention will now be explained with references to the attached drawings.

In FIGS. 1 to 4, illustrating a first embodiment of the present invention, reference numeral 1 denotes a stationary scroll member, which is integrally formed with a central housing 1*d*, to which a front housing 2 is fixedly connected by suitable means such as bolts and nuts. Reference numeral 3 denotes a rotating (or drive) shaft, which is formed with a large diameter portion 3A and a small diameter portion 3B extending integrally from the large diameter portion 3A.

The front housing 2 is formed with an outer boss portion 2-1 and an inner boss portion 2-2. Inside the outer boss portion 2-1, a circular opening 2*a* is created, in which the large diameter portion 3A of the drive shaft is supported by means of a radial ball bearing unit 4.

Axially adjacent to the opening 2*a*, the front housing 2 is formed with an axial opening 2*d*, to which a shaft seal unit 26 is stored. The shaft seal unit 26 is for preventing a lubricant included in the gas to be compressed from leaking.

Figure 4:
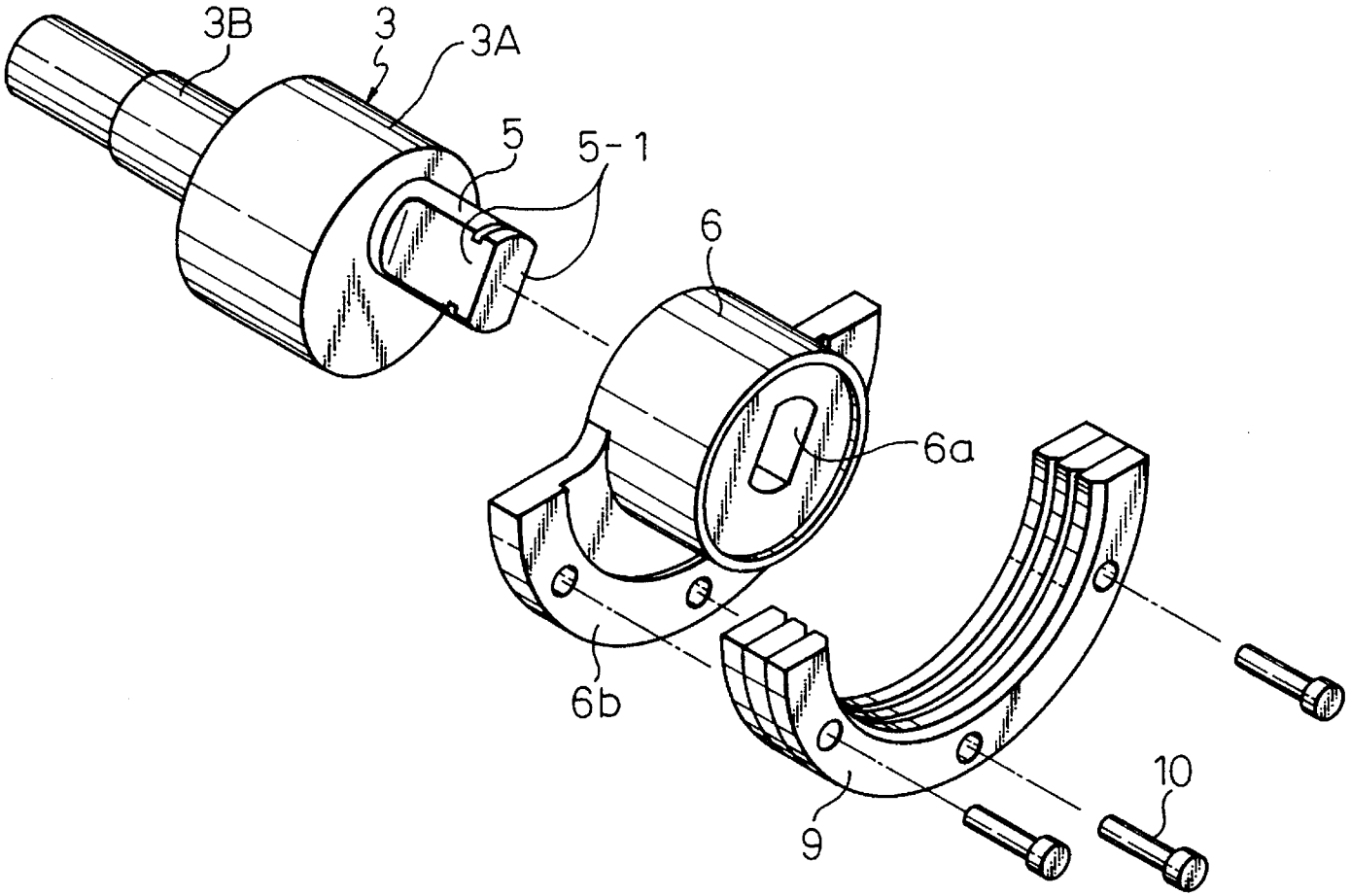
FIG. 4 is a dismantled perspective view of a rotating shaft, a bushing, and a balance weight in the compressor in FIG. 1.

At the end of the rotating shaft 3, remote from the small diameter portion 3B, an eccentric or drive shaft 5 is integrally formed so that a central axis of the eccentric shaft 5 is spaced away from an axis of the shaft 3. Namely, the eccentric shaft 5 is eccentric with respect to the rotating shaft 3. As shown in FIG. 4, the drive shaft 5 forms a pillar of a rounded transverse cross sectional shape.

Reference numeral 6 indicated a bushing which is, as shown in FIG. 4, formed with a bore 6*a* of a transverse cross sectional shape extending axially therethrough. The eccentric shaft 5 is radially slidably inserted to the bore 6*a* of the bushing 6, and a rotating movement of the rotating shaft 3 is transmitted to the bushing 6, due to the fact that circumferentially spaced outer parallel surfaces 5-1 of the eccentric shaft 5 engage with the circumferentially spaced inner parallel surfaces of the bore 6*a*. The bushing 6 is connected to the shaft 5 by means of a washer 110 and a snap ring 112.

In FIG. 1, reference numeral 8 denotes a movable scroll member which is arranged eccentric with respect to the stationary scroll member 1. The stationary scroll member 1 is constructed by a base plate portion 1*a* and a scroll portion 1*b* extending axially integrally from the base plate 1*a*. The movable scroll member 8 is also constructed by a base plate 8*a* and a scroll portion 8*b* extending integrally from the base plate 8*a*. The arrangement of the stationary and movable scroll members is such that the scroll portions 1*b* and 8*b* are in a radially contacting relationship, while an axial end of the scroll portion 1*b* of the stationary scroll member contacts the base plate 8*a* of the movable scroll member, and an axial end of the scroll portion 8*b* of the movable scroll member 8 contacts the base plate 1*a* of the stationary scroll member 1. As a result, as is well known, a plurality of radially spaced compression chambers P are formed between the stationary and movable scroll members 1 and 8.

The movable scroll member 8 is further provided with a tubular boss portion 8*c* extending integrally from an end of the base plate 8*a* remote from the scroll portion 8*b*. The bushing 6 is inserted to the tubular boss portion 8*c* via a needle bearing unit 7, so that the movable scroll member 8 is rotatably supported by the bushing 6. Namely, the boss portion 8*c* is formed with an axial opening 8*c*-1 (FIG. 3), while the needle bearing unit 7 is constructed of a plurality of circumferentially spaced needles 7-1 and a casing 7-2 for storing the needles 7-1. The casing 7-2 is fitted to the opening 8*c*-1, and a snap ring 7A is fitted to an annular groove on an inner cylindrical wall of the opening 8*c*-1 for obtaining a fixed position of the needle bearing unit 7, so that, as shown in FIG. 1, a needle chamber 100 is formed between the bushing 6 and the base plate 8*a* of the movable scroll member 8.

A rotating movement of the shaft 3 causes the movable scroll member 8 to effect an orbital movement about the axis of the shaft 3, due to the fact that the eccentric drive shaft 5 is engaged with the bore 6*a* of the bushing 6. As a result of the orbital movement of the movable scroll member, a compression chamber P is, as is well known, moved from a radially outward position, where the compression chamber of an increased volume is opened to an inlet of the gas to be compressed, to a radially inward position, where the compression chamber of a decreased volume is opened to an outlet of the compressed gas.

As shown in FIG. 4, the bushing 6 is integrally formed with a radially extending bracket 6*b* at a location diametrically opposite to the eccentric shaft 5, to which bracket a set of arc shaped balance weight members 9 are connected by means of pins 10. These pins 10 are inserted through respective bores formed in the balance weight members 9, and are crimped, which allows the balance weight members to be fixed with respect to the bushing 6. The arrangement of the balance weight members 9 is for canceling a dynamic unbalance generated by the orbital movement of the movable scroll member 8, which is eccentric with respect to the axis of the rotating shaft 3.

A self rotation blockage mechanism K is arranged between the surface 8*d* of the base plate 8*a* of the movable scroll member 8 (a pressure receiving surface on the movable side) remote from the scroll portion 8*b* and the surface 2*b* of the front housing 2 facing the movable scroll member 8 (a pressure receiving surface on the immovable side). The self rotation blockage mechanism K is for preventing the movable scroll member 8 from being rotated about its own axis, while allowing the movable scroll member 8 to effect the orbital movement about the axis of the rotating shaft 3. Namely, self rotation blockage mechanism K is constructed by a self rotation blocking ring 11 and a plurality of circumferentially and equiangularly spaced self rotation blocking pins 12, which are freely inserted into corresponding bores in the ring 11. In FIG. 1, the front housing 2 forms at the pressure receiving surface 2*b* on the immovable side forms circumferentially spaced recesses 2*c* of a predetermined number of, for example, 4, while the movable scroll member 8 forms at the pressure receiving surface 8*d* on the movable side forms circumferentially and equiangularly spaced recesses 8*e* of a predetermined number which is equal to the number of the recess 2*c*. In other words, circumferentially and equiangularly spaced four sets of the oppositely faced recess 2*c* and 8*e* are provided. The pins 12 are, at their ends, projected out of the ring 11 and are engaged with the recess 2*c* and 8*e*, respectively, of the corresponding pairs at their radially opposite surfaces.

Between the locations where the pins 12 are provided, the ring 11 is formed with pressure receiving portions 11*a*, which are, at their inner and outer surfaces, in contact with the pressure receiving surface 8*d* on the movable side and the pressure receiving surface 2*b* on the immovable side, respectively. As a result, a reaction force caused by the compression in the compression chambers P is transmitted, from the surface 8*d* to the surface 2*b* by way of the pressure receiving portions 11*a*.

Figure 2:
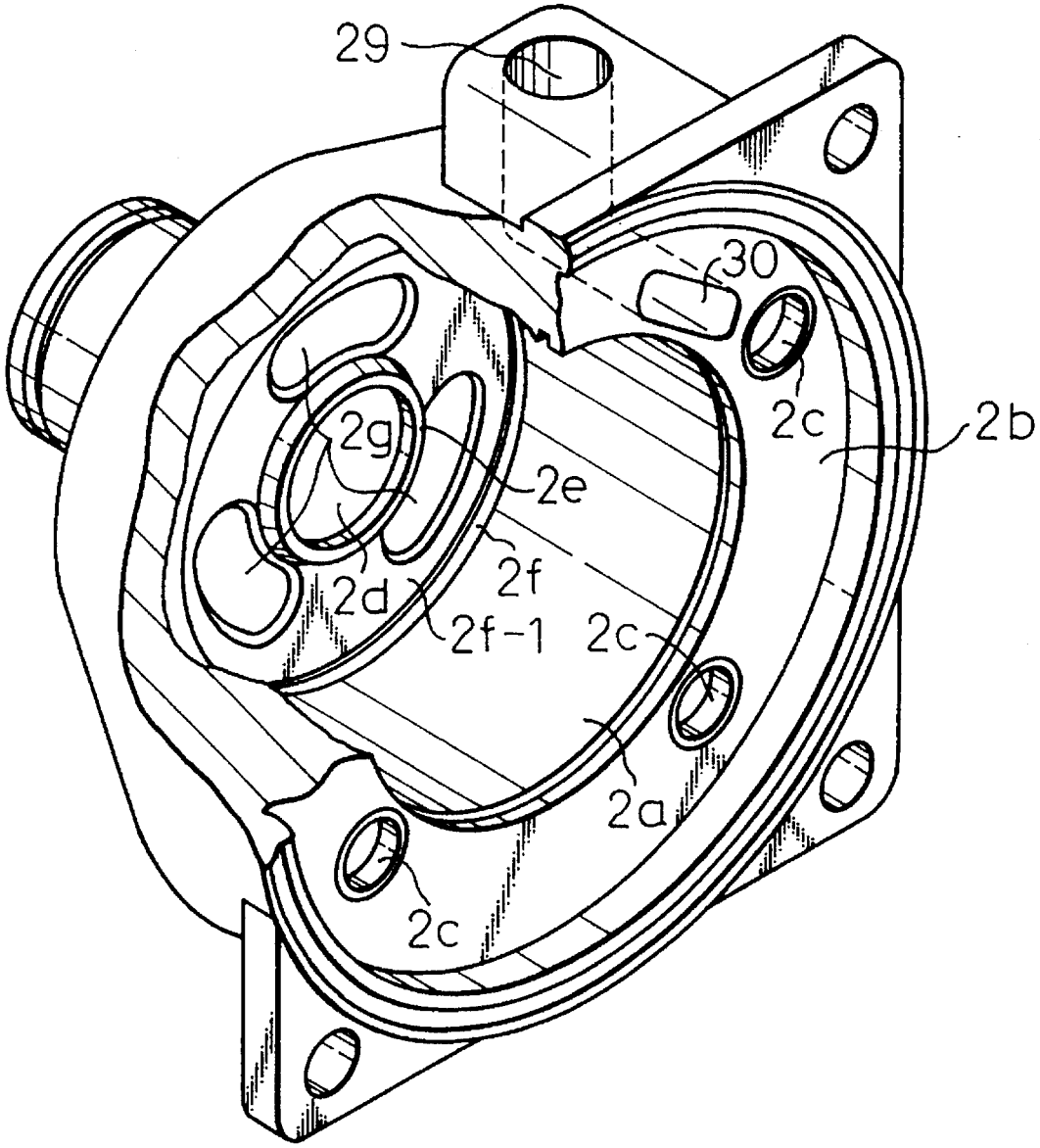
FIG. 2 is a perspective view in partial cross-section of a front housing of the scroll compressor in FIG. 1.

An intake chamber 13 is formed between the movable scroll member and an inner peripheral wall of the center housing 1*d*. As shown in FIG. 2, the front housing 2 is formed with an intake port 29 opened to an outside source (an evaporator in a refrigerating circuit) of the gas to be compressed and an intake passageway 30 having a first end connected to the intake port 29 and a second end opened to the space inside the center housing 1*d* and the front housing 2. As a result, the refrigerant gas from the intake port 29 is introduced into the intake chamber 13 via gaps in the self-rotation blocking mechanism K.

A rear housing 14 is connected to an rear end of the stationary scroll member 1, so that a outlet chamber 15 is created between the base plate .la of the stationary scroll member 1 and the rear housing 14. An outlet valve 16 is arranged in the outlet chamber 15, which includes a reed valve 16-1, a stopper plate 16-2, and a bolt 16-3 for connecting one end of the reed valve 16-1 to the base plate la together with the stopper plate 16-2. The reed valve 16-1 is, due its resiliency, usually a position where the outlet port 1*c* is closed. The base plate 1*a* of the stationary scroll member 1 is formed with a tubular flange portion 1*e*, which forms an opening opened to the outlet chamber 15. The tubular flange 1*e* is connected to a condenser (not shown) in a refrigerating circuit.

Figure 3:
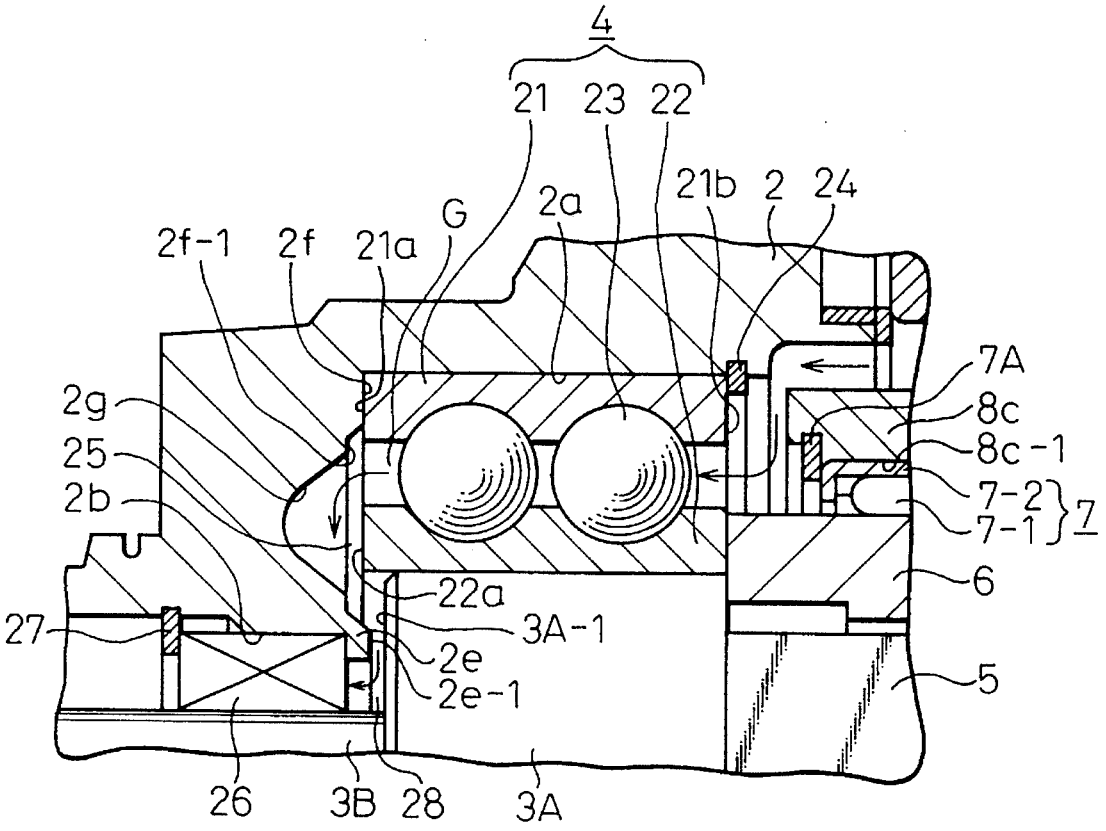
FIG. 3 is an enlarged cross-sectional view of a portion of the shaft seal unit and a bearing unit in FIG. 1.

Now, a construction for supporting the rotating shaft 3 will be explained. As shown in FIG. 1, the bearing unit 4 for supporting the rotating shaft is constructed by an outer race 21, an inner race 22 and two axially spaced rows of circumferentially spaced balls 23. The outer race 21 is fitted to the opening 2*a* of the front housing 2. The inner race 22 is fitted to the large diameter portion 3A of the rotating shaft 3. As shown in FIG. 3, the front housing 2 forms, at a front axial end of the opening 2*a*, an inner surface (shoulder portion) 2*f*, with which the outer race 21 of the bearing unit 4 contacts at its front end 21*a* (FIG. 3), while a snap ring 24 is fitted to an annular groove formed at the inner circumferential wall of the opening 2*a*, so that the outer race 21 contacts, at its rear end 21*b*, with the snap ring 24. As a result, the axial position of the bearing unit 4 is fixed.

As is clearly shown in FIGS. 2 and 3, the housing is formed with an annular recessed, surface 2*f*-1 which is located inwardly from the surface 2*f*, which contacts the axial end 21*a* of the outer race 21 of the bearing unit 4. As a result, a small annular space 25 is formed between the surface 2*f*-1 of the housing 2 and the surfaces 21*a* and 22*a* of the bearing unit 4. The annular space 25 is opened to a gap G between the outer race 21 and inner race 22 of the bearing unit 4.

As shown in FIG. 3, at a rear end of the bore 2*d* for storing the shaft seal unit 26, the front housing 2 forms a annular projection 2*e* functioning as a shaft seal stopper. The shaft seal unit 26 contacts, at its rear end, with the annular projection 2*e*, and contacts, at its front end, with a snap ring 27 fitted to an annular groove formed at the inner wall of the opening 2*d*, so that an axial position of the shaft seal unit 26 is fixed. The annular projection 2*e* as an axial stopper for the shaft seal unit 26 is spaced from an opposite end surface of the large diameter portion 3A of the rotating shaft 3. As a result, between the projection 2*e* and the large diameter portion 3A, a sealing chamber 28 is created, which is in communication with the annular chamber 25.

In FIG. 3, the front end surface 3A-1 of the large diameter portion 3A of the rotating shaft 3 is axially rearwardly spaced from the front end surface 22*a* of the inner race 22 of the bearing unit 4, while the stopper portion 2*e* is axially rearwardly projected so that a rear end surface 2*e*-1 of the stopper portion 2*e* is located axially rearwardly from the rear end surface 2*f* of the housing 2 contacting with the front end surface 21*a* of the outer race 21 of the bearing unit. As a result of such an axially rearwardly projected arrangement of the seal stopper portion 2*e*, a small volume of the sealing chamber 28 is obtained, which does not cause the lubrication to be worsened according to the present invention. Namely, the surface 2*f*-1 for creating the space 25 with respect to the opposite surface 21*a* and 22*a* of the bearing unit 4 is formed with circumferentially spaced three recess 2*g* of a substantially V cross sectional shape. As a result, a necessary amount of the lubricant can be held in the recess 2*g*. The number of the recess 2*g* is not required to be three, and any number of desired recesses 2*g* can be employed to obtain a desired lubrication. Namely, the number of the recess 2*g* may be 1 or 2 or 4 or more.

Now, an operation of the scroll compressor according to the present invention will be explained.

A rotating movement, from a rotating movement source such as an internal combustion engine, is transmitted to the rotating shift 3, which causes the eccentric shaft 5 as well as the bushing 6 to be rotated about the axis of the shaft 3. As a result, the movable scroll member 8 rotatably mounted to the bushing 6 effects an orbital movement about the axis of the shaft 3, while the self rotation blockage mechanism K prohibits the self rotation of the movable scroll member 8 about its own axis. Namely, due to an arrangement of plurality of circumferentially spaced pins 12 engaging radially with opposite pairs of recess 2*c* and 8*e*, the pins 12 supports radially the movable scroll member at circumferentially spaced locations, thereby preventing the movable scroll member from being rotated about its own axis. During the orbital movement of the movable scroll member, the ring 10, to which the pins 12 are freely inserted, effects an orbital movement of a radius, which is expressed by $2\times(R-r)$, where R is a diameter of the circular recess 2*c* and 8*c*, and r is a diameter of the pin 12.

The orbital movement of the movable scroll member 8 causes, first, the intake chamber 13 to be sealed as a compression chamber P, and causes, second, the compression chamber to be displaced radially inwardly while the volume is reduced. Thus, the gaseous refrigerant introduced from an evaporator (not shown) in a refrigerating circuit, into the intake chamber 13 via the intake port 29 and the intake passageway 30 is subjected to a compression at the compression chamber P, and is finally discharged, via the outlet port 1*c*, into the outlet chamber 15 by displacing the reed valve 16-1 against the force of the elasticity of the reed valve 16-1. Then, the gaseous refrigerant from the outlet chamber 15 is discharged, via the outlet flange 1*e*, into a condenser (not shown) in the refrigerating circuit.

During the compression of the gas in the compression chambers P, a compression pressure reaction force is generated, in the movable scroll member 8, which is received by the front housing 2, via the pressure receiving portions 11*a* of the ring 11, which is in contact with the movable scroll member 8 at the movable-sided pressure receiving surface 8*d*, on one hand, and with the immovable-sided pressure receiving surface 2*b*, on the other hand.

In the first embodiment, as explained above and as shown in FIG. 3, the inner surface of the front housing 2 facing the bearing unit 4 has the portion 2*f*-1, which is a radially inward extension of the portion 2*f* contacting with the outer race 21 of the bearing unit 4 and which is spaced from the front end surface 22*a* of the inner race 22 of the bearing unit 4, on one hand, while the stopper portion 2*e* of the front housing 2 for an engagement with the shaft seal unit 26 is located adjacent to the front end surface 3A-1 of the large diameter portion 3A of the rotating shaft 3, on the other hand. As a result, a reduction of the distance $L_1$ between an outer, front end surface of the front housing 2 and the front end of the bearing unit 4 is obtained. Furthermore, the provision of the stopper portion 2*e* displaced axially inwardly toward the bearing unit 4 allows the shaft seal unit 26 to be located adjacent to the bearing unit 4, since the rear end surface 2*e*-1 of the stopper portion 2*e* is located on the rear side with respect to the end surface 2*f*, with which the outer race 21 of the bearing unit 4 contacts. As a result, a reduction of the distance $L_2$ between an outer, front end surface of the front housing 2 and the front end of the bearing unit 4 is obtained. As a result, a reduction of the size as well as weight of the front housing 2 is obtained, thereby reducing the size as well as the weight of the compressor, which makes it easy for the compressor to be housed in a limited space in the engine compartment of an automobile.

The refrigerant gas in the intake chamber 13 is diverted, via the gap G in the bearing unit 4, into the space 25, and is introduced into the sealing chamber 28 for lubricating the shaft seal unit 26. Furthermore, the gas from the sealing chamber 28 can also in a reverse direction flow via the space 25 and the gap G. As a result, a desired lubrication of the seal unit as well as the bearing unit 4 by the mist state lubricant is possible. Furthermore, the provision of the plurality of circumferentially spaced recesses 2*g* on the inner surface 2*f*-1 makes it easy for the gas to flow between the gap G and the sealing chamber 28.

Figure 5:
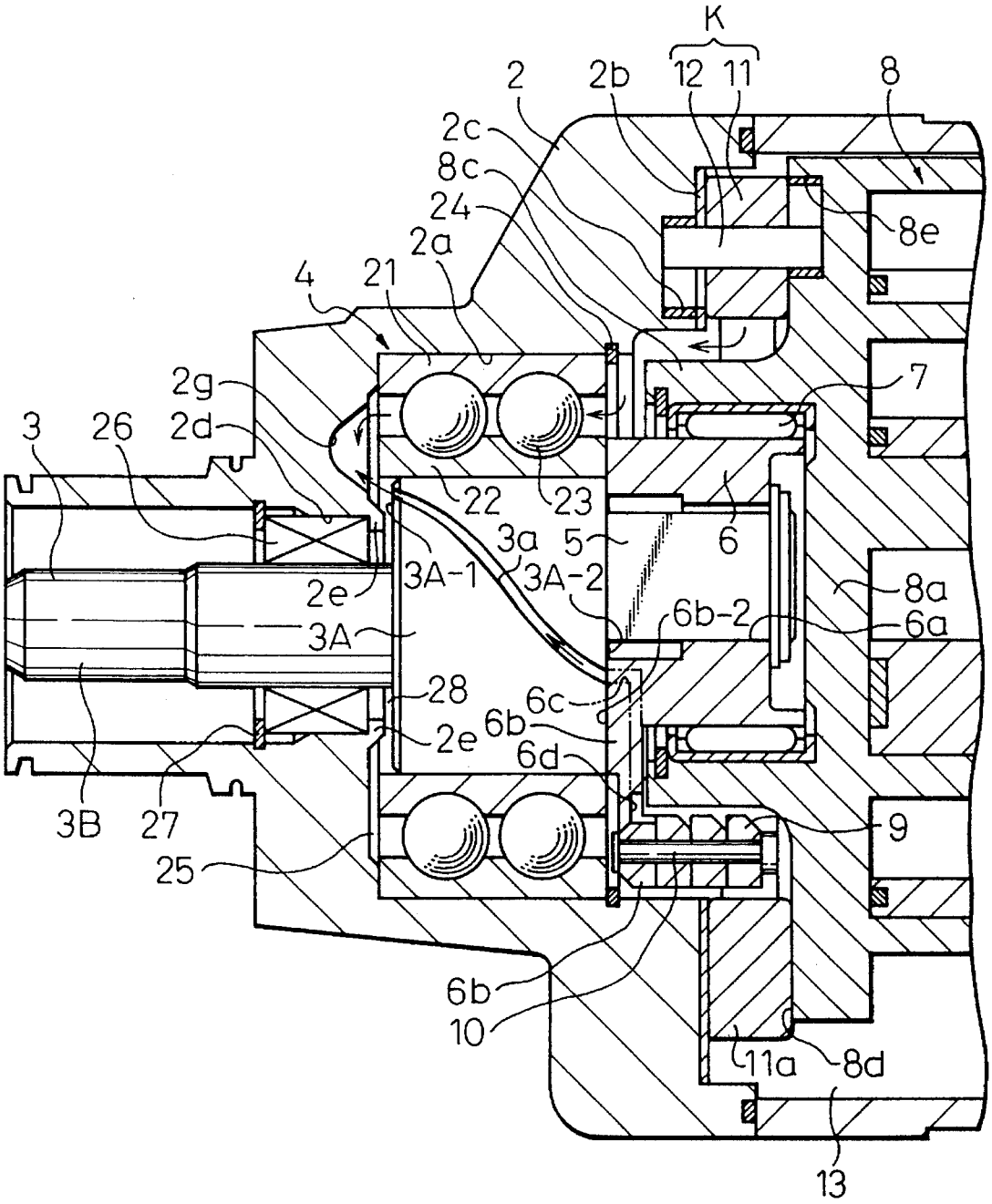
FIG. 5 is a partial longitudinal cross sectional view of the scroll compressor in a second embodiment of the present invention.
Figure 6:
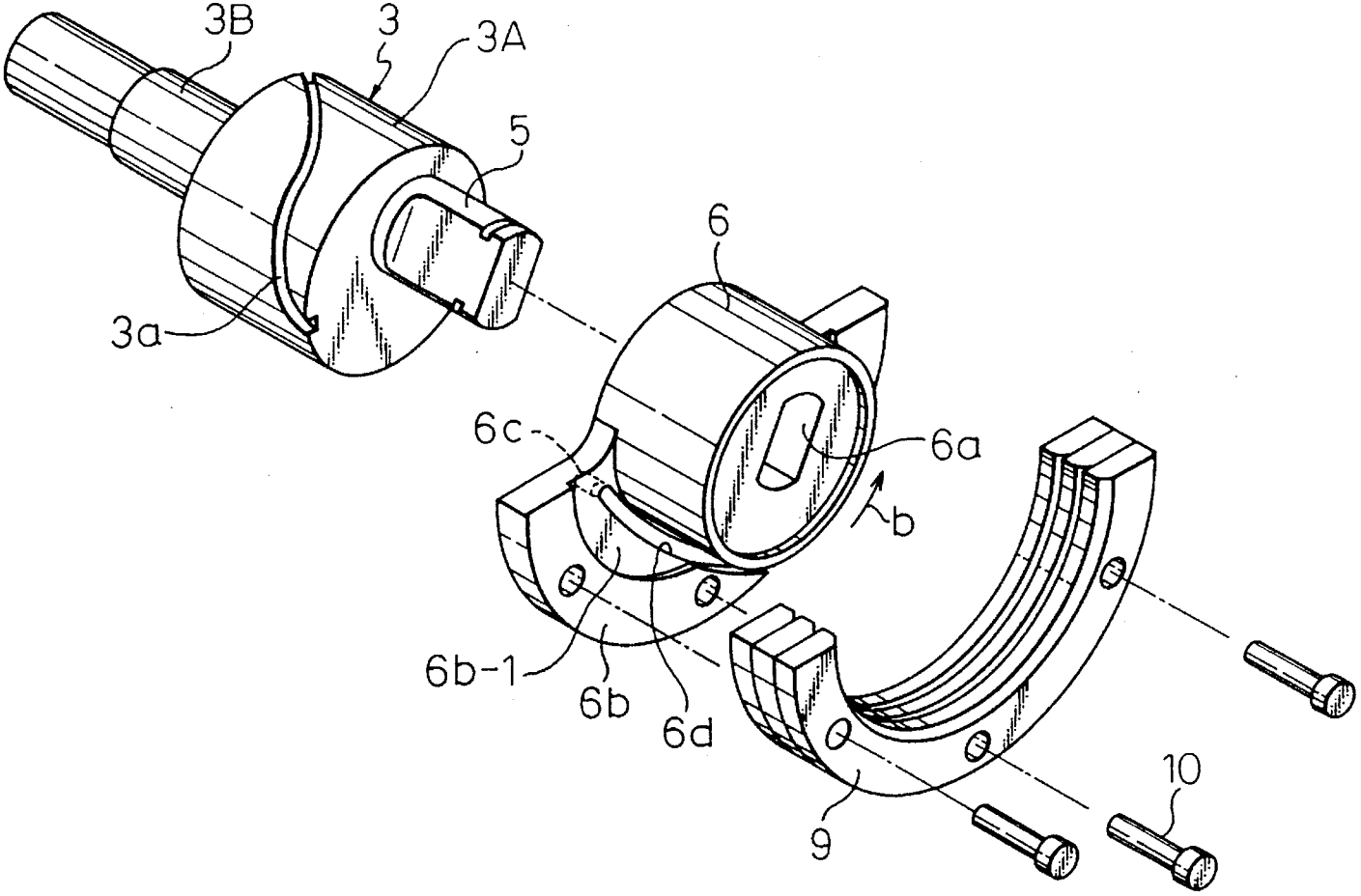
FIG. 6 is a dismantled perspective view of a rotating shaft, a bushing, and a balance weight in the compressor in FIG. 5.

FIGS. 5 and 6 show a second embodiment of the present invention, where the large diameter portion 3A of the rotating shaft 3 is, on its outer cylindrical surface, formed with a groove 3*a*. The helical groove 3*a* has a first (front) end which extends to the front end surface 3A-1 of the large diameter portion 3A so as to be opened to the chamber 25 and a second (rear) end opened to the rear end surface 3A-2 contacting with the front end surface 6*b*-2 of the bracket 6*b* of the bushing 6. The bushing 6 is formed with an axial opening 6*c* which is, on its front end, in communication with the rear end of the groove 3*a* and is, on its rear end, opened to a recessed rear wall 6*b*-1 of the bracket 6*b* of the bushing 6, as shown in FIG. 6. Furthermore, on the rear surface 6*b*-1 of the bracket 6*b*, a groove 6*d* is formed in such a manner that the groove 6*d* extends radially outwardly via the boundary area between the bracket 6*b* and the weight members 9 so as to open to the intake chamber 13 at the outer periphery of the weight members 9, while the groove 6*d* is forwardly inclining with respect to the direction of the rotation of the bushing 6 and the weight member 9, as shown by an arrow b in FIG. 6. A rotating movement of the bushing 6 and the weight member 9 causes the refrigerant gas in the chamber 13 to be caught by the groove 6*d* and then to be introduced into the axial opening 6*c*. The remaining construction of the second embodiment in FIGS. 5 and 6 are similar with that in the first embodiment. Thus, a detailed explanation will be omitted.

In the second embodiment in FIGS. 5 and 6, a modification is conceivable, where the grooves 2*g* are eliminated. Namely, even if the grooves 2*g* are lacking, the provisions of the helical groove 3*a*, the axial opening 6*c* and the radial groove 6*c* allows the flow of gas to be promoted between the annular space 25 and the sealing chamber 28, thereby improving the lubrication of the bearing 4 as well as the shaft seal unit 26.

In the operation of the second embodiment, introduction of the gaseous refrigerant in the intake chamber 13 into the sealing chamber 28 is done not only through the gap G and the space 25, as is the case also for the first embodiment, but also through the groove 6*d*, the hole 6*c*, and the groove 3*a*. Namely, the rotating movement of the bushing 6 causes the gaseous refrigerant in the chamber 13 to be caught by the groove 6*d*. The gas is, then, introduced into the sealing chamber 28 via the hole 6*c* in the bracket 6 and the groove 3*a* on the large diameter portion 3A of the rotating shaft 3. As a result, according to the second embodiment, a circulation of an increased amount of the gas between the gap G and sealing chamber 28 is obtained, thereby improving the lubrication of the bearing unit 4 as well as of the seal unit 26.

Figure 7:
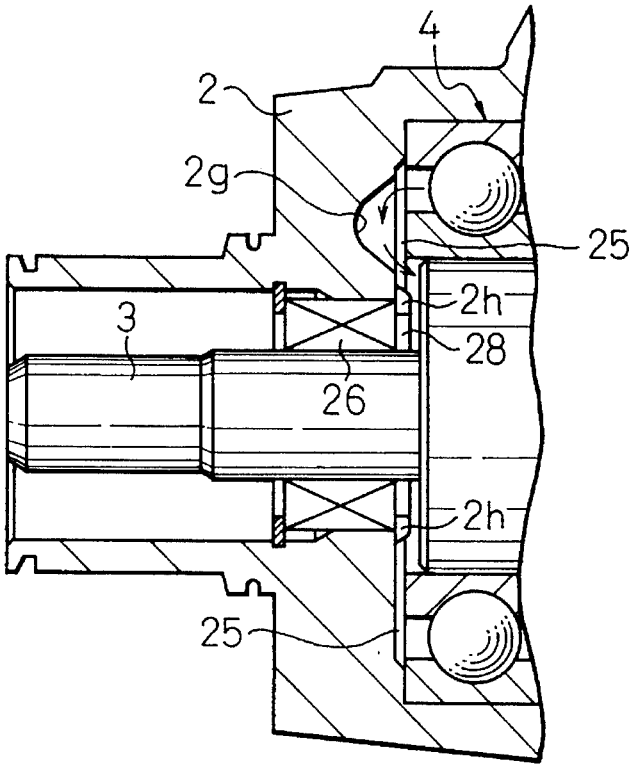
FIG. 7 is a partial longitudinal cross sectional view of the scroll compressor in a third embodiment of the present invention.
Figure 8:
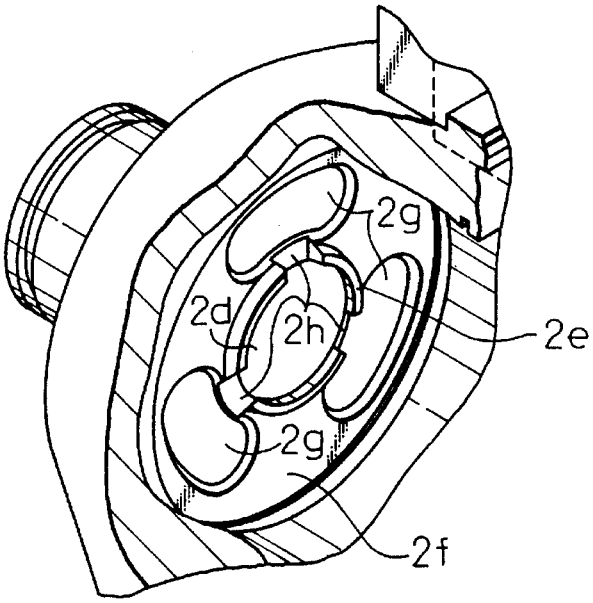
FIG. 8 is a perspective view in partial cross-section of a front housing of the scroll compressor in FIG. 7.

In a third embodiment shown in FIGS. 7 and 8, the front housing 2 is, at its inner surface adjacent the stopper projection 2*e* for the shaft seal unit 26, formed with a plurality of circumferentially spaced cut-out portions 2*h* which connect the space 25 between the faces 2*f*-1 and 22*a* with the shaft seal chamber 28. The remaining construction of the third embodiment is the same as that of the first embodiment. The provision of the cut-out portions 2*h* is effective for increasing the amount of flow of the refrigerant gas between the space 25 and the shaft seal chamber 28. As a result, an improved lubrication of the bearing unit 4 as well as of the shaft seal unit 26 is obtained. The number of grooves 2*h* is not limited to 3, but may include 1,2,4 or more.

In the embodiment in FIGS. 7 and 8, a modification is conceivable, where the grooves 2*g* are eliminated. Namely, even if the grooves 2*g* are missing, the provisions of the cut-out portions 2*h* allows a flow of gas to be promoted between the annular space 25 and the sealing chamber 28, thereby improving lubrication of the bearing 4 as well as lubrication of the shaft seal unit 26.

Figure 9:
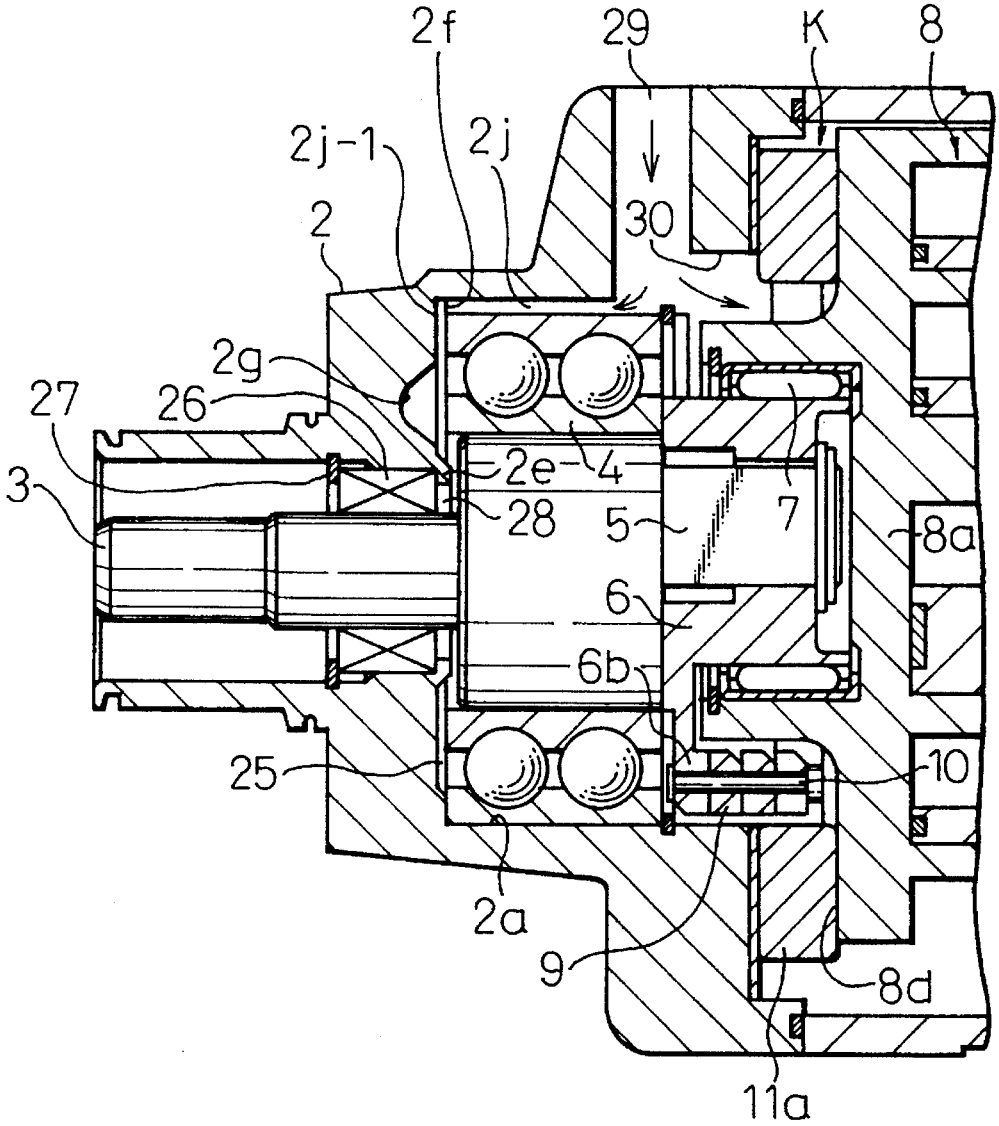
FIG. 9 is a partial longitudinal cross sectional view of the scroll compressor in a fourth embodiment of the present invention.
Figure 10:
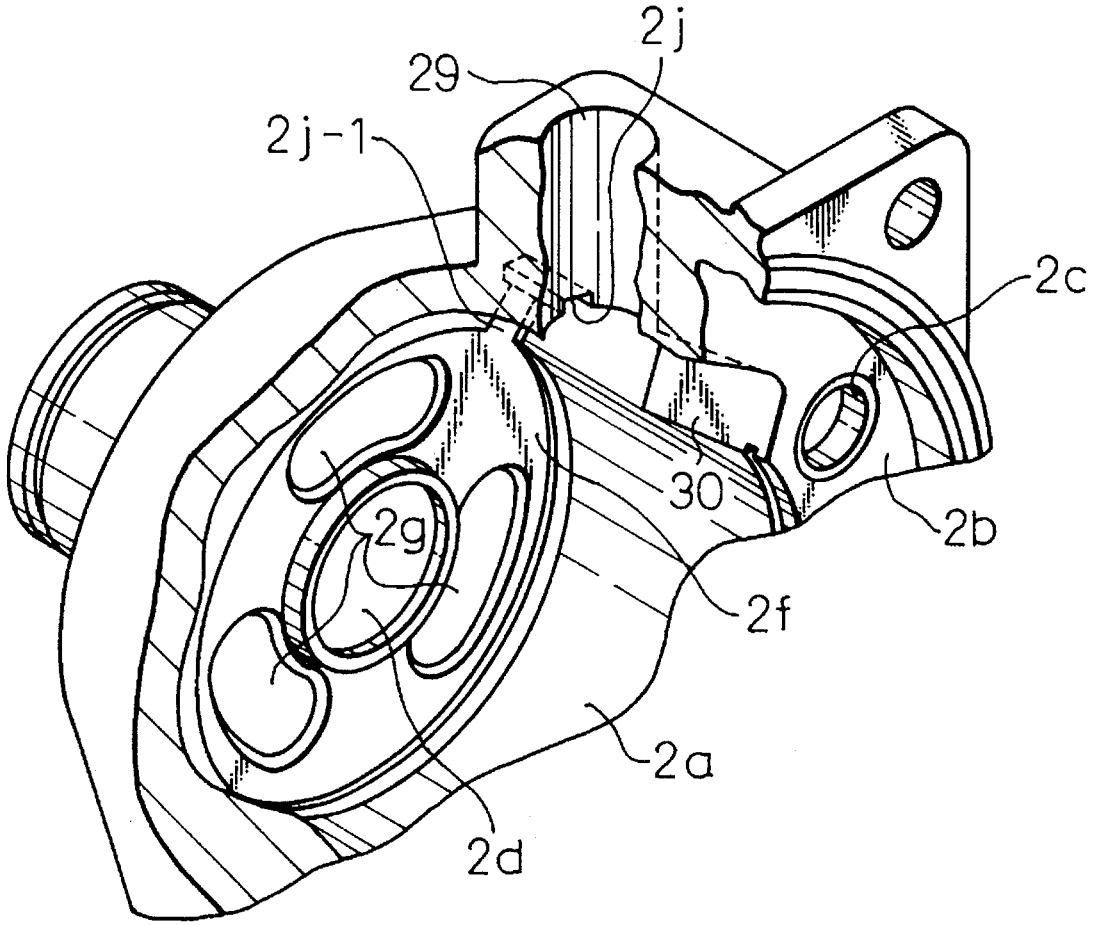
FIG. 10 is a perspective view in partial cross-section of a front housing of the scroll compressor in FIG. 9.

FIGS. 9 and 10 shows a fourth embodiment, where, in addition to the intake passageway 30 for connecting the intake port 29 with the intake chamber 13, a sub-intake passageway is provided. Namely, as shown in FIG. 10, the front housing 2 is, at the inner wall of the bore 2*a* for receiving the outer race 21 of the bearing 4, formed with a axial groove 2*j* having one end opened to the intake passageway 30, and is, at the inner wall 2*f* abutting the outer race of the bearing unit 4, formed with a radial groove 2*j*-1 having a first end opened to the other end of the groove 2*j* and a second end opened to the space 25. These axial and radial grooves 2*j* and 2*j*-1 form the sub-intake passageway 30-1, which connects the intake passageway 30 with the space 25. The remaining construction of the embodiment is the same as that in the first embodiment.

In this fourth embodiment, when the refrigerant gas, from the intake port 29, is introduced into the intake passageway 30, the gas is partly diverted into the groove 2*j*-1, and is introduced into the space 25 and then to the sealing chamber 28. As a result, an increased amount of gas may be introduced into the sealing chamber 28 Thus, an improved lubrication of the bearing unit 4 as well as of the shaft seal unit 26 is obtained.

Furthermore, in the fourth embodiment, the grooves 2*j* and 2*j*-1 for constructing the sub-intake passageway are formed at the inner surfaces of the opening 2*a* for fitting the bearing unit 4. As a result, the machining of these grooves can easily be done from the inner or rear side of the opening 2*a*.

Figure 11:
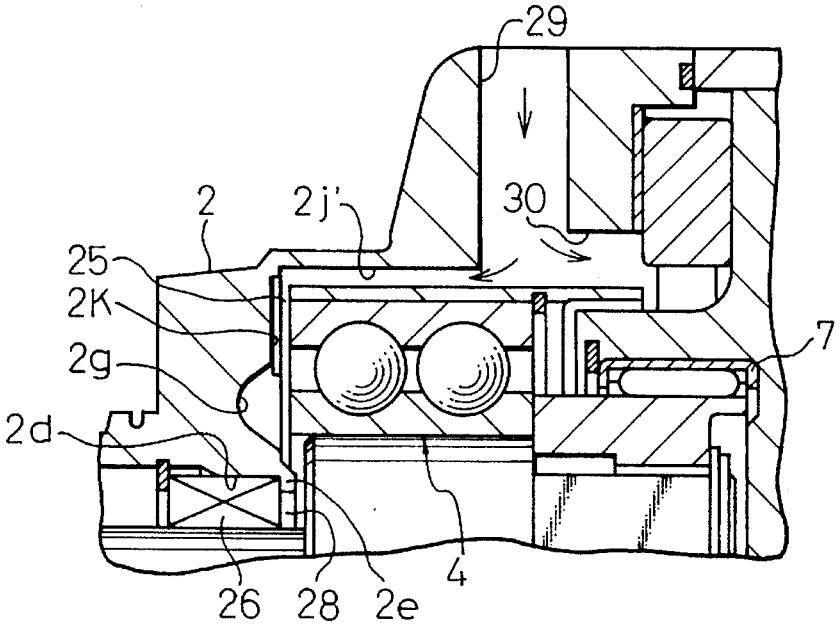
FIG. 11 is a partial longitudinal cross sectional view of the scroll compressor in a fifth embodiment of the present invention.
Figure 12:
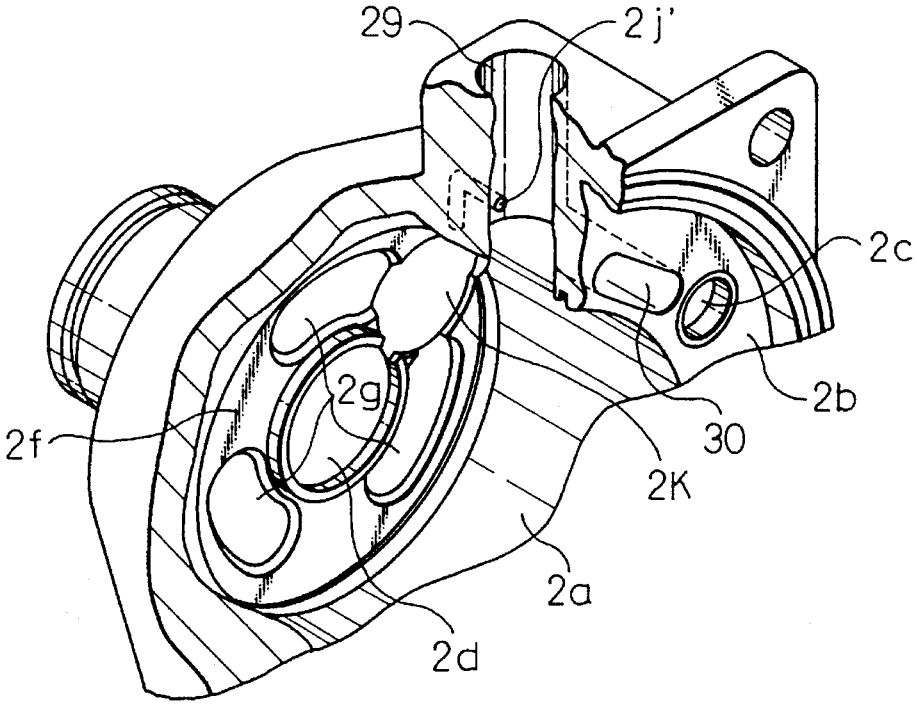
FIG. 12 is a perspective view in partial cross-section of a front housing of the scroll compressor in FIG. 11.

Now, a fifth embodiment will be explained with reference to FIGS. 11 and 12. In this embodiment, in place of the groove on the inner wall of the opening 2*a* for the bearing unit 4 as in the case in the fourth embodiment, the front housing 2 is formed with an opening 2*j'* which is, in its one end, opened to the intake port 29. Furthermore, the front housing 2 forms, at its inner wall 2*f*, a recess 2*k*, which extends, generally, in a radial direction, so that the recess 2*k* is, at its radially outer end, in communication with the opening 2*j'*, and is, at its radially inner end, opened to the central bore 2*d* for storing the shaft seal unit 26. In addition, the recess 2*k* is formed with a circumferentially widened radially middle portion, which is in communication with the circumferentially adjacent groove 2*g*, as illustrated in FIG. 12.

In the fifth embodiment, refrigerant gas diverted from the intake passageway 30 is introduced into the sealing chamber 28 via the opening 2*j'* and the recess 2*k*. Furthermore, the gas in the recess 2*k* is also introduced into the grooves 2*g*. As a result, an increased amount of refrigerant gas may be introduced into the grooves 2*g* thereby improving the lubrication of the bearing unit 4 as well as the shaft seal unit 26.

Figure 13:
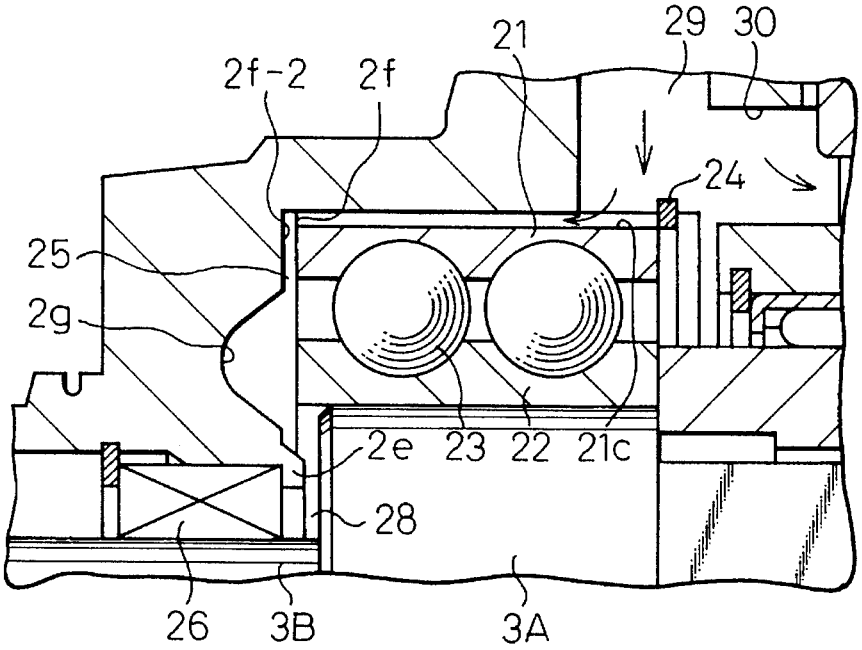
FIG. 13 is a partial longitudinal cross sectional view of the scroll compressor in another embodiment of the present invention.

In a modification shown in FIG. 13, in the bearing unit 4, the outer race 21 is, at its outer cylindrical wall, formed with an axial groove 21*c* therethrough, which is on its rear end opened to the intake passageway 30 and is on its front end opened to a radial groove 2*f*-2 formed on the inner wall 2*f* of the housing. As a result, a communication passageway is created by the grooves 21*c* and 2*f*-2 for connecting the intake passageway 30 with the space 25 for diverting the refrigerating gas into the sealing chamber 28. This modification is advantageous in that a machining of the groove 21*c* is easier than in the fifth embodiment shown in FIGS. 11 and 12.

Figure 14:
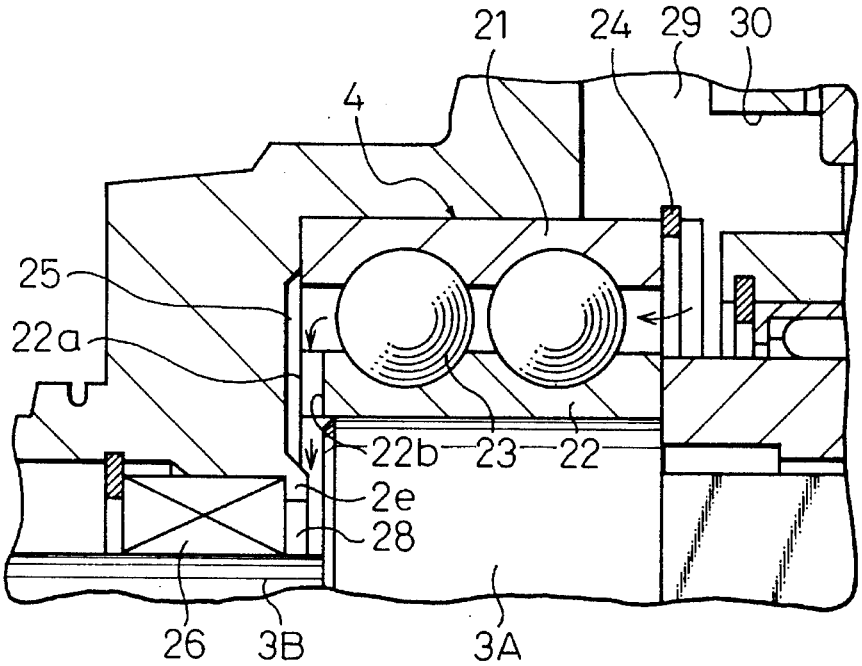
FIGS. 14 to 16 are similar to FIG. 13 but respectively show different embodiments of the present invention.

In another modification shown in FIG. 14, in place of the grooves 2*g* on the inner wall 2*f* of the front housing as shown in the first embodiment, the front end surface 22*a* of the inner race 22 of the bearing unit 4 is formed with a recess 22*b* or a plurality of recesses 22*b*. The provision of the recess 22*b* allows the gas flow amount to be increased between the small space 25 and the sealing chamber 28. As a result, an improved lubricating condition of the bearing unit 4 as well as of the shaft seal unit 26 is obtained.

Figure 15:
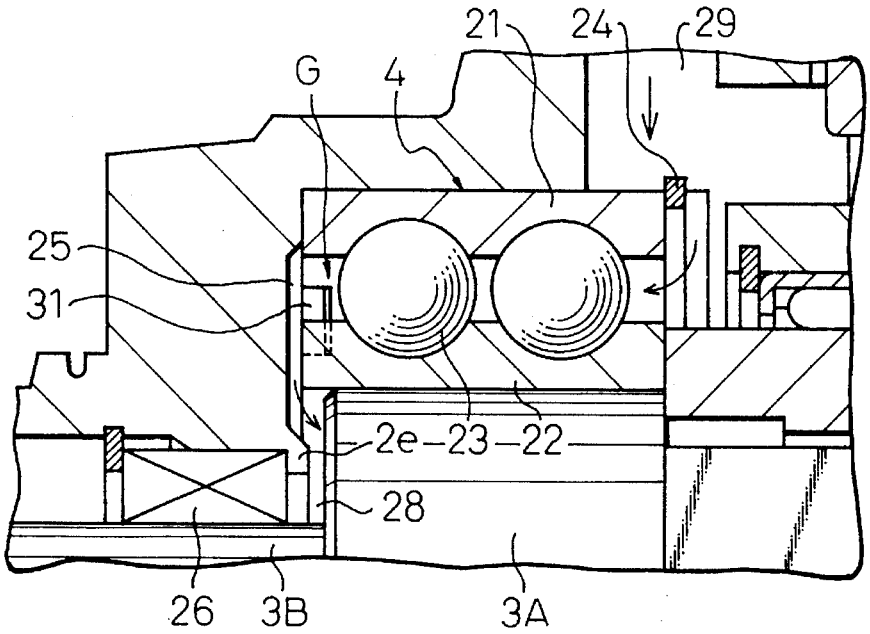

In a still another modification as shown in FIG. 15, in place of the grooves 2*g* on the inner wall 2*f* of the front housing as shown in the first embodiment, a plurality of circumferentially spaced blades 31 are connected to the inner race 22 of the bearing unit 4 along the front end thereof. The rotation of the inner race 22 upon the rotating movement of the shaft 3 causes the gaseous refrigerant in the gap G to be forcibly discharged into the space 25, thereby improving the lubrication of the bearing unit 4 and the shaft seal unit 26.

The modifications in FIGS. 14 and 15 are advantageous in that the dimension L of the housing 2 is reduced over that in the first embodiment since the grooves 2*g* are eliminated.

Figure 16:
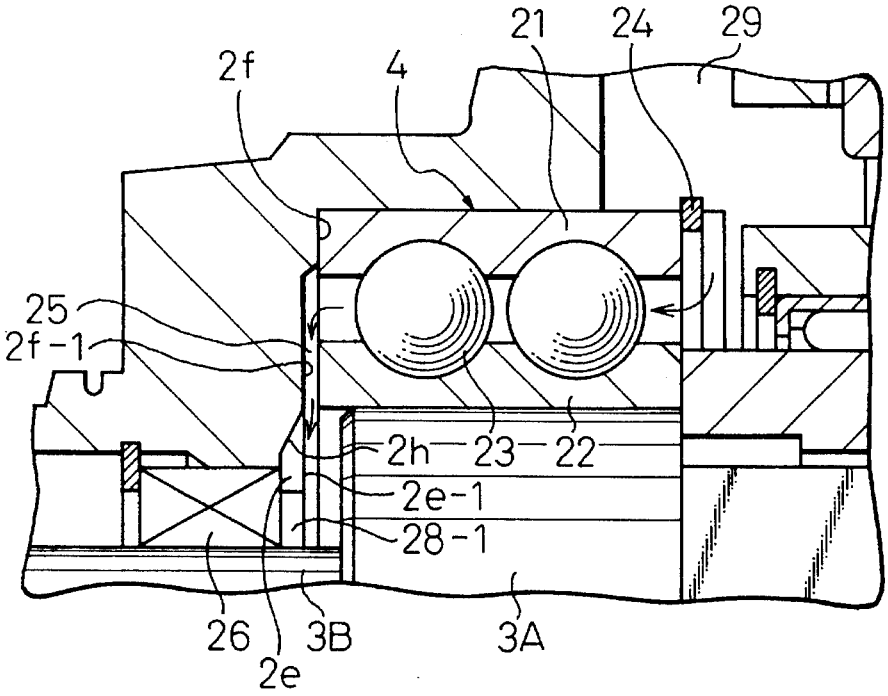

In place of axially projecting the stopper portion 2*e* toward the front end surface of the large diameter portion in preceding embodiments, in a modification in FIG. 16, the stopper portion 2*e* forms a rear end surface 2*e*-1 which is co-planar with respect to the bottom surface of the recess 2*f*-1 for creating the small space 25. Furthermore, at the rear surface of the stopper portion 2*e*, a recess 2*h* or a plurality of recess 2*h* is or are provided. The recess 2*h* allows an increased amount of the gaseous refrigerant to be introduced into the sealing chamber 28. In this modification, the shaft seal assembly 26 is located relatively outwardly, causing the length as well as the weight of the compressor to be slightly increased.

Figure 17:
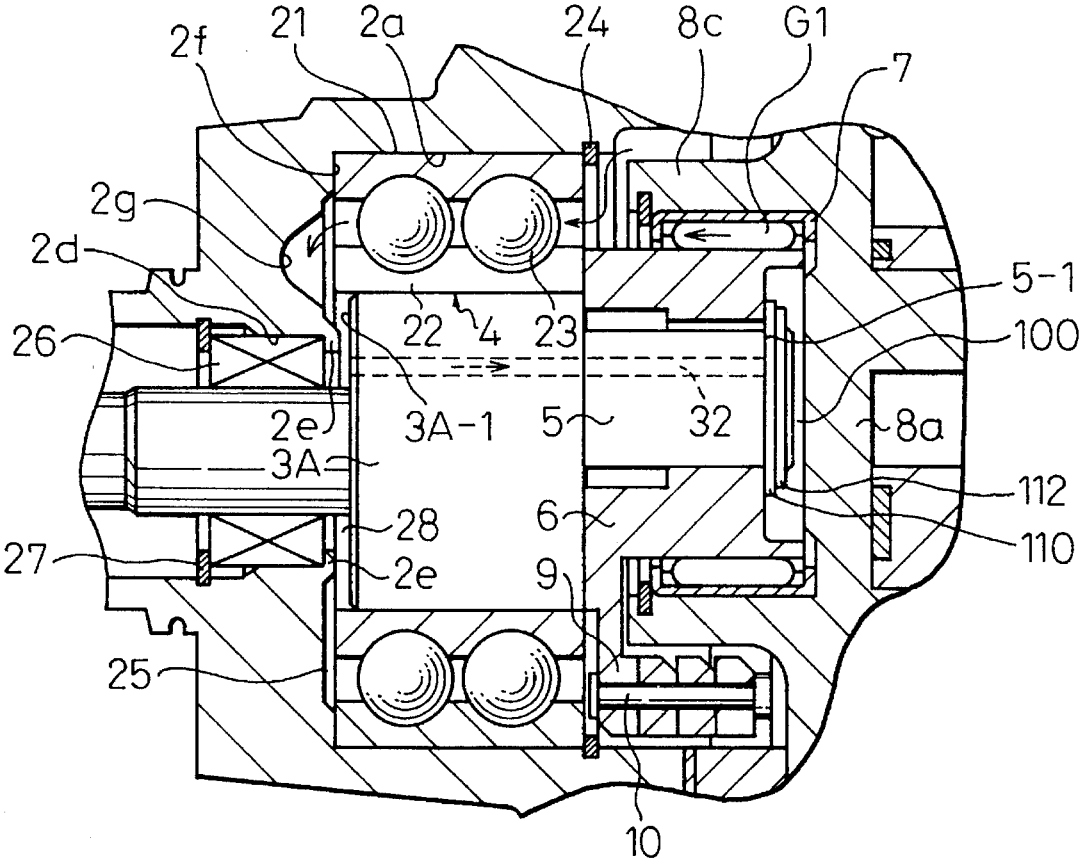
FIG. 17 is a partial longitudinal cross sectional view of the scroll compressor in a further embodiment of the present invention.

In a modification shown in FIG. 17, the rotating shaft 3 is formed with an opening 32 extending axially therethrough and has a front end opened to the front end surface 3A-1 of the large diameter portion 3A of the rotating shaft 3 and a rear end opened to a rear end surface 5-1 of the drive shaft 5, so that a communication is created between the needle bearing chamber 100 and the sealing chamber 28 via gap between the shaft 5, the washer 110 and the snap ring 112. A flow of the gaseous refrigerant is generated in a gap G1 in the bearing unit 7, thereby improving, also, the lubrication of the bearing 7.

We claim:

1. A scroll compressor for a gas including a lubricant, comprising:

a housing;

a drive shaft having an axis for a rotation, the drive shaft having a first portion of a small diameter and a second portion of a large diameter;

a radial bearing for supporting the drive shaft rotatably with respect to the housing;

a seal unit cooperating with the small diameter portion of the shaft for preventing the lubricant from leaking;

a stationary scroll member which is in a fixed relationship with respect to the housing;

a movable scroll member arranged eccentric with respect to the stationary scroll member so that at least one pump chamber is created between the scroll members;

the housing forming, at a front portion, a first axially extending opening and a second axially extending opening of a diameter smaller than that of the first opening;

the housing being further formed with a shoulder portion between the first and second axial openings, and an inwardly extending projection at an end of the second opening adjacent the radial bearing;

the radial bearing including an inner race fitted to the large diameter portion of the shaft, an outer race fitted to the first opening of the housing so that the outer race axially contacts with said shoulder portion and a plurality of circumferentially spaced bearing members;

the seal unit arranged adjacent to the radial bearing on the side opposite to the scroll members, the seal unit being axially engaged with the inwardly extending projection;

means for connecting the movable scroll member with respect to the drive shaft so as to obtain an orbital movement of the movable scroll about the axis of the shaft;

means for preventing the movable scroll member from being rotated, so that the orbital movement of the movable scroll member allows the pump chamber to be moved from an outward position to an inward position;

intake means for introducing gas to be compressed into the pump chamber when the pump chamber is located in the outward position;

outlet means for discharging the gas, as compressed, when the pump chamber is located in the inward position;

said housing forming, at a location inward of the shoulder portion, a recessed surface which is spaced from a faced end of the inner race of the radial bearing, so that a small space is formed between the housing and the radial bearing;

said inwardly extending projection being arranged adjacent a faced end surface of said increased diameter portion of the rotating shaft so as to form a sealing chamber therebetween, and;

lubricating means, on at least one of the housing, the radial bearing and the rotating shaft, for lubricating the radial bearing as well as the shaft seal unit.

2. A scroll compressor according to claim 1, wherein a front end surface of the large diameter portion of the rotating shaft is spaced rearward from a front end surface of the inner race of the radial bearing, and the inwardly extending projection has a rear end surface located rearward from the front end surface of the inner race of the radial bearing.

3. A scroll compressor according to claim 1, wherein said lubricating means comprises at least one groove on an inner surface of the front housing opened to said small space.

4. A scroll compressor according to claim 1, wherein said lubricating means comprises a passageway means formed along the rotating shaft for obtaining a communication between the sealing chamber and an low pressure side of the pump.

5. A scroll compressor according to claim 4, wherein said passageway means comprises a helical groove on an outer cylindrical surface of the large diameter portion of the rotating shaft, the helical groove having a first end opened to the sealing chamber and a second end opened to a rear end surface of the large diameter portion, and wherein the means for connecting the movable scroll member comprises a bushing, an axial opening in the bushing having a first end opened to the helical groove and a second end opened to a rear surface of the bushing so as to be opened to an intake chamber thereby diverting the gas in the intake chamber into the sealing chamber and said small space.

6. A scroll compressor according to claim 5, wherein the bushing is formed with a radially extending groove having an inner end opened to the axial opening and an outer end opened to the intake chamber, the radial groove being forwardly inclined with respect to the direction of the rotation of the bushing.

7. A scroll compressor according to claim 1, wherein said lubricating means comprises at least one groove formed on a rear surface of the inwardly extending projection for communicating said small space with the sealing chamber.

8. A scroll compressor according to claim 1, wherein said lubricating means comprises at least one groove formed on the shoulder portion of the front housing facing the outer race of the radial bearing.

9. A scroll compressor according to claim 1, wherein said lubricating means comprises at least one axial groove formed on the inner cylindrical wall of the first opening of the housing for inserting the outer race of the radial bearing, said axial groove having one end opened to the small space and a second end opened to the intake means.

10. A scroll compressor according to claim 1, wherein said lubricating means comprises at least one axial groove formed on the outer cylindrical wall of the outer race of the radial bearing, said axial groove having one end opened to the small space and a second end opened to the intake means.

11. A scroll compressor according to claim 1, wherein said lubricating means comprises at least one radial groove formed on the front wall of the inner race of the radial bearing.

12. A scroll compressor according to claim 1, wherein said lubricating means comprise a blade member fixed to the inner race of the radial bearing.

13. A scroll compressor according to claim 1, wherein said means for connecting the movable scroll member with respect to the drive shaft comprises an eccentric shaft connected to the large diameter portion of the drive shaft and a bushing connected to the eccentric shaft; and wherein said lubricating means comprises a passageway formed in the large diameter portion of the shaft and the eccentric shaft, the passageway has one end opened to a space between the busing and a movable scroll member and a second end opened to the said small space.

* * * * *